US011220799B2

(12) United States Patent
Johnson

(10) Patent No.: US 11,220,799 B2
(45) Date of Patent: Jan. 11, 2022

(54) METHODS AND DEVICES FOR TRAINING PETS AND THE DISPOSAL OF WASTE

(71) Applicant: Monique Hope Johnson, Mendham, NJ (US)

(72) Inventor: Monique Hope Johnson, Mendham, NJ (US)

( * ) Notice: Subject to any disclaimer, the term of this patent is extended or adjusted under 35 U.S.C. 154(b) by 296 days.

(21) Appl. No.: 15/961,107

(22) Filed: Apr. 24, 2018

(65) Prior Publication Data

US 2018/0238004 A1 Aug. 23, 2018

Related U.S. Application Data

(63) Continuation of application No. 14/675,691, filed on Mar. 31, 2015, now Pat. No. 9,957,677.

(60) Provisional application No. 61/974,346, filed on Apr. 2, 2014.

(51) Int. Cl.
*A01K 29/00* (2006.01)
*E01H 1/12* (2006.01)

(52) U.S. Cl.
CPC ..... *E01H 1/1206* (2013.01); *E01H 2001/126* (2013.01)

(58) Field of Classification Search
CPC . E01H 1/1206; E01H 1/12; E01H 2001/1293; E01H 2001/126; A01K 23/005
USPC ..... 294/1.3, 1.4, 1.5
See application file for complete search history.

(56) References Cited

U.S. PATENT DOCUMENTS 4,645,251 A 2/1987 Jacobs
4,788,733 A 12/1988 Lerner
4,902,283 A 2/1990 Rojko et al.
4,959,881 A 10/1990 Murray
4,964,188 A 10/1990 Olsen
5,178,426 A 1/1993 David et al.
5,301,806 A 4/1994 Olsen
5,438,708 A 8/1995 Jacovitz
5,473,789 A 12/1995 Oster
5,704,670 A 1/1998 Surplus
RE35,814 E 6/1998 Olson
5,806,668 A 9/1998 Bixby
6,203,080 B1 3/2001 Surplus
(Continued)

FOREIGN PATENT DOCUMENTS

DE 202005004825 U1 8/2005
FR 2882627 A1 9/2006

OTHER PUBLICATIONS

International Search Report and Written Opinion, PCT/US2015/023926, 12 pages, dated Jul. 13, 2015.

*Primary Examiner* — Paul T Chin
(74) *Attorney, Agent, or Firm* — Myers Wolin, LLC

(57) ABSTRACT

Method and device for disposal of waste including, without limitation, human or animal waste. Disposal device includes a bag-like member coupled to an absorbent member. The bag-like member may be folded for compact storage prior to use and unfolded during use thereof. A method for collecting, removing, and/or disposing of waste utilizing the disposal device including the steps of: unfolding the bag-like member; inserting a hand therein; collecting waste with the absorbent member; inverting the bag-like member so as to effectively wrap the absorbent member and waste within the bag-like member; optionally sealing the bag-like member; and disposing of the disposal device, the waste contained within the disposal device.

16 Claims, 7 Drawing Sheets

(56) References Cited

U.S. PATENT DOCUMENTS

| | | | | |
|---|---|---|---|---|
| 6,227,145 | B1 | 5/2001 | Miyamoto et al. | |
| 6,237,971 | B1 | 5/2001 | Gilley | |
| 6,244,216 | B1 | 6/2001 | Ochi | |
| 6,405,678 | B2 | 6/2002 | Ikegami et al. | |
| 6,481,766 | B1 | 11/2002 | May et al. | |
| 6,511,111 | B2 | 1/2003 | Dooley et al. | |
| 6,553,938 | B2 | 4/2003 | Ikegami et al. | |
| 7,231,888 | B1 | 6/2007 | Kelly et al. | |
| 7,493,870 | B2 | 2/2009 | Takashi et al. | |
| 7,891,320 | B2 * | 2/2011 | Otsuji et al. | A01K 1/0107 119/169 |
| 8,042,489 | B2 | 10/2011 | Takahashi et al. | |
| 8,042,490 | B2 | 10/2011 | Takahashi et al. | |
| 8,388,589 | B2 | 3/2013 | Kaneko et al. | |
| 8,578,888 | B2 | 11/2013 | Komatsubara et al. | |
| 9,151,005 | B1 * | 10/2015 | Hao | E01H 1/1206 |
| 2001/0042517 | A1 | 11/2001 | Ikegami et al. | |
| 2002/0000206 | A1 | 1/2002 | Ikegami et al. | |
| 2002/0043810 | A1 | 4/2002 | Dooley | |
| 2005/0052037 | A1 | 3/2005 | Spuck | |
| 2006/0260556 | A1 | 11/2006 | Renforth | |
| 2007/0000446 | A1 | 1/2007 | Dunn et al. | |
| 2008/0174128 | A1 | 7/2008 | Jezzi | |
| 2010/0084880 | A1 | 4/2010 | Avilez et al. | |
| 2010/0154716 | A1 | 6/2010 | Smith | |
| 2010/0224133 | A1 | 9/2010 | Hiroshima et al. | |
| 2011/0210571 | A1 | 9/2011 | Dan | |
| 2012/0167837 | A1 | 7/2012 | Valliant | |
| 2012/0325160 | A1 | 12/2012 | Goldberg | |
| 2013/0068169 | A1 | 3/2013 | Miller | |

* cited by examiner

METHODS AND DEVICES FOR TRAINING PETS AND THE DISPOSAL OF WASTE

CROSS REFERENCE TO RELATED APPLICATION

This application is a continuation of U.S. patent application Ser. No. 14/675,691, filed Mar. 31, 2015, which claims the benefit of U.S. Provisional Patent Application No. 61/974,346, filed on Apr. 2, 2014, the contents of each of which are incorporated by reference herein.

BACKGROUND OF THE INVENTION

Embodiments of the present invention generally relate to methods and devices for training pets and the disposal of waste. More specifically, the present invention relates to methods and devices for the sanitary collection, removal, and disposal of waste including, without limitation, human and animal waste.

BRIEF SUMMARY OF THE INVENTION

Briefly stated, in one aspect of the present invention, a waste collection, removal, and/or disposal device is provided. This device includes a bag-like member, the bag-like member having an open end and an opposite closed end; and an absorbent member coupled to the bag-like member.

In another aspect of the present invention, a method for collecting, removing, and/or disposing of waste is provided. This method includes the steps of: inserting a hand through an open end of a disposal device; grabbing at least one of the absorbent member, the bag-like member, and combinations thereof; collecting waste; and inverting the bag-like member. In one aspect, the disposal device includes a bag-like member, the bag-like member having an open end and an opposite closed end; and an absorbent member coupled to the bag-like member.

In another aspect of the present invention, a method for collecting, removing, and/or disposing of waste is provided. This method includes the steps of: placing a disposal device on a surface accessible by an animal; allowing the animal to perform an action relative to the absorbent member, the action selected from the group consisting of urination, defecation, and combinations thereof; lifting at least a portion of the disposal device from the surface; grabbing at least one of the absorbent member, the bag-like member, and combinations thereof; and inverting the bag-like member. In one aspect, the disposal device includes a bag-like member, the bag-like member having an open end and an opposite closed end; and an absorbent member coupled to the bag-like member.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1A:
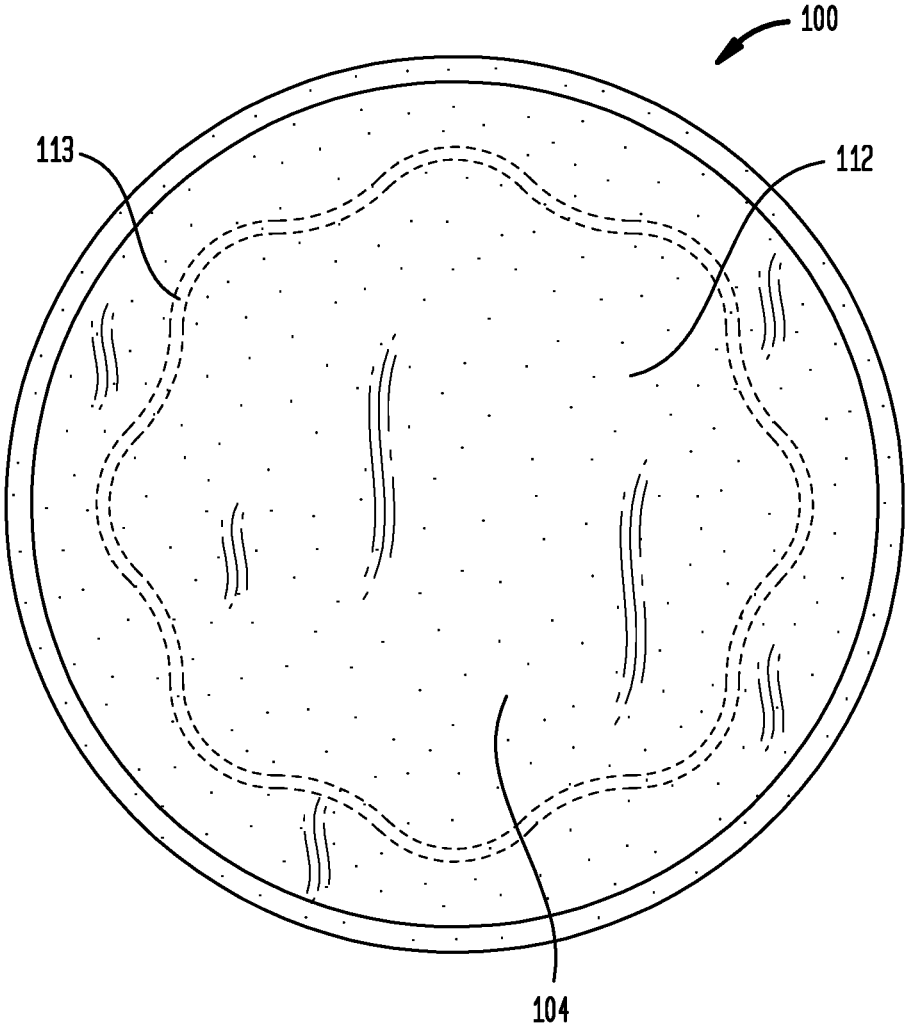
FIG. 1A is a front view of a disposal device depicting the face of an absorbent member in accordance with one embodiment of the present invention.

Certain terminology may be used in the following description for convenience only and is not limiting. The words "lower" and "upper" and "top" and "bottom" designate directions in the drawings to which reference is made. The terminology includes the words above specifically mentioned, derivatives thereof and words of similar import.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "an absorbent member" may include a plurality of absorbent members. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods, constructs and materials are now described. All publications mentioned herein are incorporated herein by reference in their entirety. Where there are discrepancies in terms and definitions used in references that are incorporated by reference, the terms used in this application shall have the definitions given herein.

Referring to FIGS. 1 through 4, depicted are various views of a disposal device 100 in accordance with one embodiment of the present invention. Disposal device 100 may be used for waste collection including, without limitation, collection of human and animal waste and the cleanup of other liquid spills and associated matter. In the depicted embodiment, disposal device 100 includes a disposable bag-like member 102 coupled to an absorbent member 104.

Bag-like member 102 includes open end 108 and closed end 110. In the depicted embodiment, bag-like member 102 is made of a thin, water-proof/-resistant, biodegradable material such as polyethylene, however, alternate materials may be substituted including, without limitation, vinyl, latex, polypropylene, and cellophane. In the depicted embodiment, bag-like member 102 is an elongated tube having a substantially circular cross-section at its proximal end and two handles at its distal end. However, alternate shapes and alternatively shaped cross-sections may be substituted including, without limitation, triangular, square, rectangular, flattened, and the like. Also, bag-like member 102 may be formed with a varying quantity of handles or no handles at all.

Also, in the depicted embodiment, bag-like member 102 has a diameter of approximately six (6) inches and a length of approximately twelve (12) inches such that the distal ends of handles 118 extend approximately to the user's elbow or upper forearm when a user's hand is fully inserted therein. However, bag-like member 102 and/or handles (when included) may be manufactured in many varying widths and lengths to fit a variety of users and/or to accommodate a variety of coverage options (i.e., extend to wrist with and/or without handles, extend above the elbow with and/or without handles) without departing from the scope hereo.

Figure 3A:
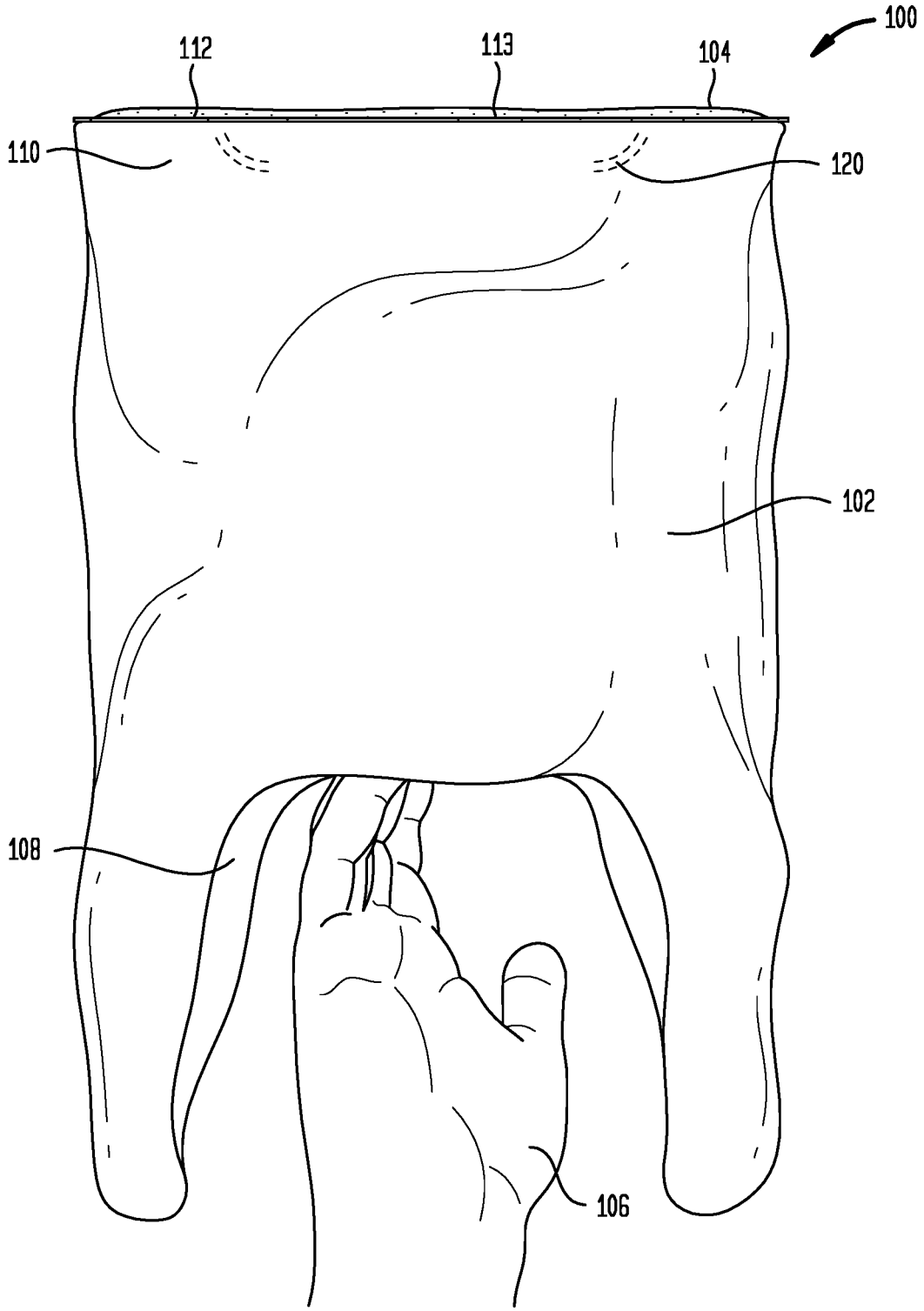
FIG. 3A is a first side view of the disposal device of FIGS. 1 and 2 with the bag-like member unfolded in accordance with one embodiment of the present invention.
Figure 3B:
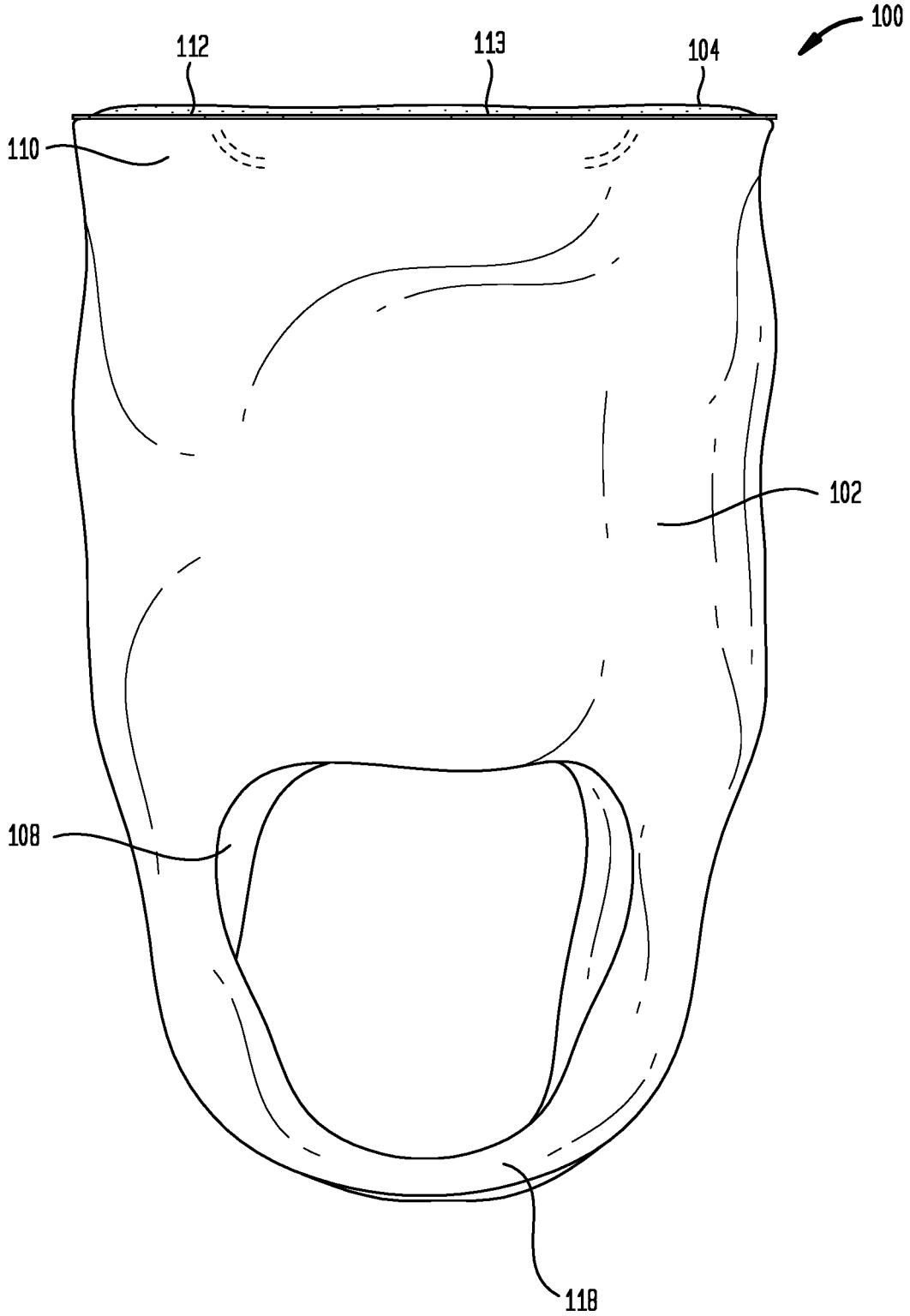
FIG. 3B is a second side view of the disposal device of FIGS. 1 and 2 rotated ninety degrees relative to the view shown in FIG. 3A to depict a pair of handles in accordance with one embodiment of the present invention.
Figure 4:
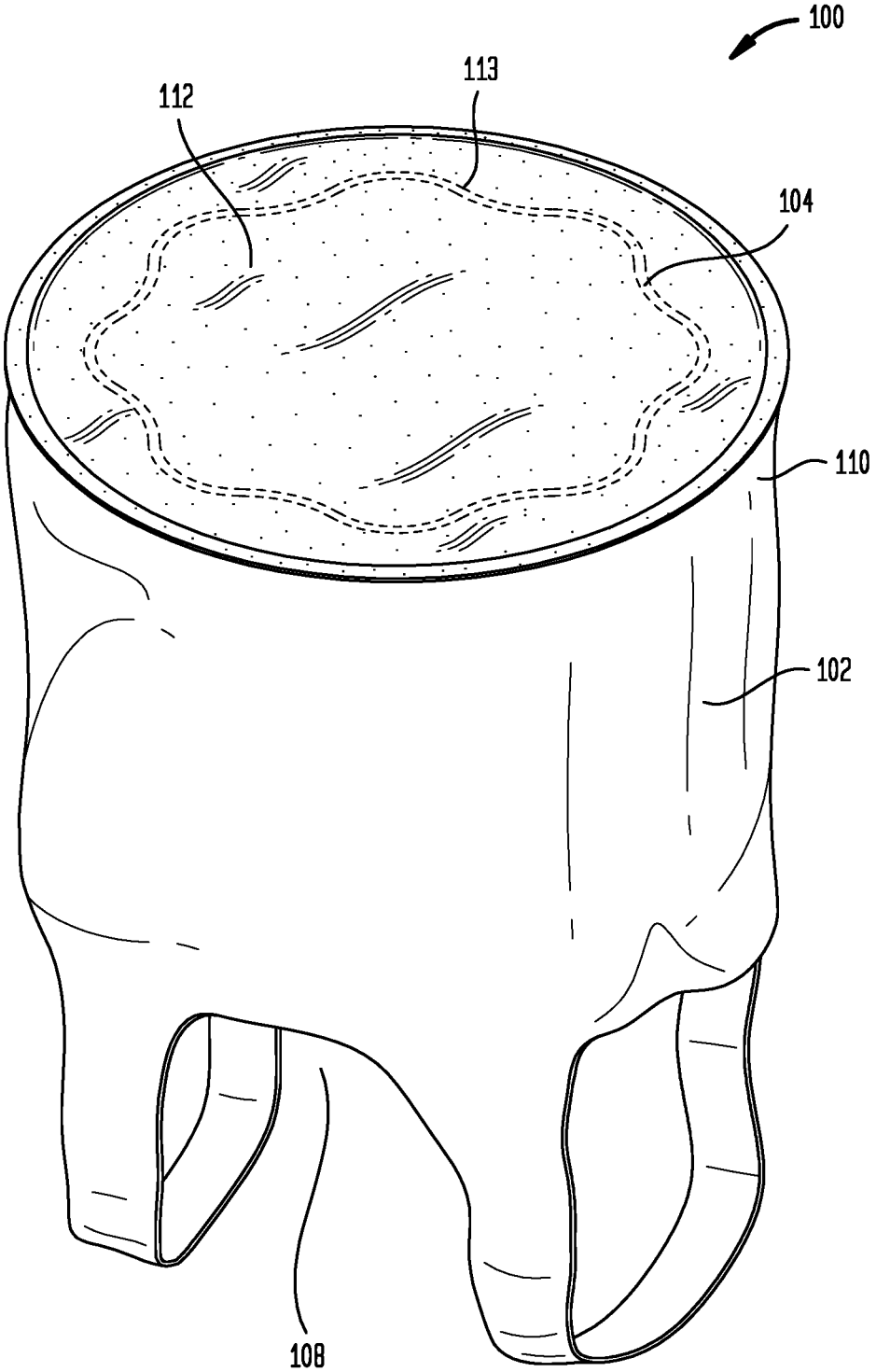
FIG. 4 is an angled side view of the disposal device of FIGS. 1 and 2 with the bag-like member unfolded in accordance with one embodiment of the present invention.

As best seen in FIGS. 3A and 3B, the bag-like member of the depicted embodiment also includes a grip 120 at its closed end and internal to bag-like member 102. In the depicted embodiment, the grip is in the form of an enlarged loop through which a user's hand may pass in order to provide the user with a better grip of the closed end of bag-like member 102 and its associated absorbent member 104. However, grip 120 may be omitted and/or alternate grips may be substituted including, without limitation, smaller loops, tabs, or the like.

In the depicted embodiment of the present invention, absorbent member 104 includes pad 112 and back 114 (FIG. 1B), both of which are substantially circular and have a diameter of approximately six (6) inches. However, alternate shapes and dimensions may be substituted without departing from the scope hereof.

Figure 1B:
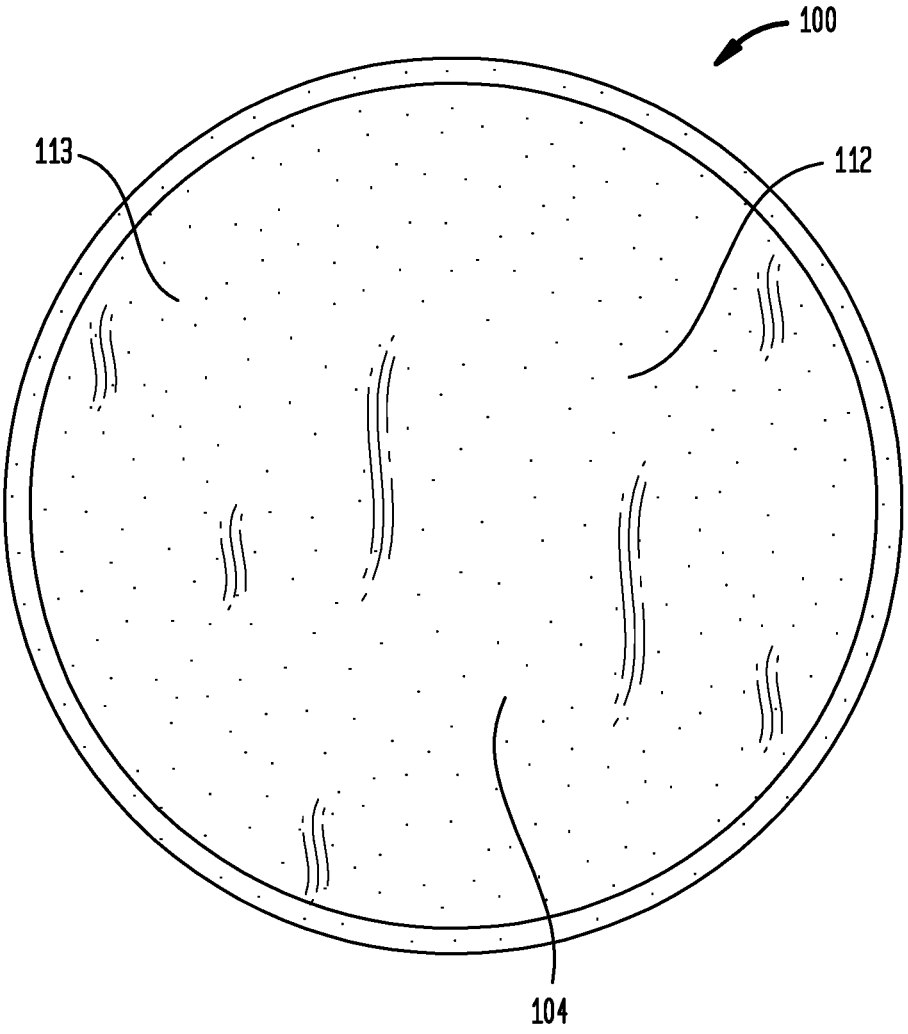
FIG. 1B is a rear view of an absorbent member in accordance with one embodiment of the present invention.

As depicted in FIG. 1B, back 114 is a relatively thin sheet of plastic that is of substantially similar size and shape as pad 112 and is attached to pad 112 along its perimeter. Back 114 acts as a barrier to prevent liquids or other material absorbed or otherwise in contact with pad 112 from passing through absorbent member 104 into the interior of bag-like member 102. This minimizes the potential that the hand of the user contacts the materials being handled by disposal device 100. However, alternate methods of preventing such contact other than back 114 may be substituted without departing from the scope hereof including, without limitation, a chemical barrier painted on the interior surface of pad 112. Or, alternatively, the end of bag-like member 102 coupled to absorbent member 104 may be sealed, thereby preventing passage of liquids or other materials into member 102. In such a scenario, absorbent member 104 may include a pad 112 only.

In the depicted embodiment, pad 112 is comprised of a material that can absorb and retain the material to be disposed. In the depicted embodiment, the pad material is a biodegradable material such as cellulose. However, alternate materials may be substituted without departing from the scope hereof including, without limitation, paper, algae, cotton, bamboo, hemp, cloth, gelatin, synthetic fiber/microfiber fabric (e.g., polyester/polyamide), sawdust, grain hulls, minerals, and magnesium carbonate. Also, non-biodegradable materials may also be utilized without departing from the scope hereof. Pad 112 may be multi-layered to allow separate layers for better absorption, retention of the liquid or other material being disposed, and for attachment to the bag-like member 102, however, single layered absorbent members are also envisioned.

In the depicted embodiment, pad 112 is saturated with a liquid such as a disinfectant, antibacterial, a cleaning agent, or the like to assist with cleaning of the surface from which material is being removed for disposal. However, alternate embodiments are envisioned in which varying types of liquids are substituted or no liquid is utilized without departing from the scope hereof.

Turning now to FIGS. 3A and 3B, depicted are side views of disposal device 100. The back 114 of absorbent member 104 is coupled to bag-like member 102 via an adhesive, heat sealing, or other means known in the art, thereby leaving the outwardly facing surface 113 of pad 112 available for absorbing liquid. In the depicted embodiment, back 114 is coupled to closed end 110 of bag-like member 102 but alternate embodiments are envisioned in which absorbent member 104 is coupled to other areas of bag-like member 102 including, without limitation, areas proximal to open end 108 of bag-like member 102.

Figure 2:
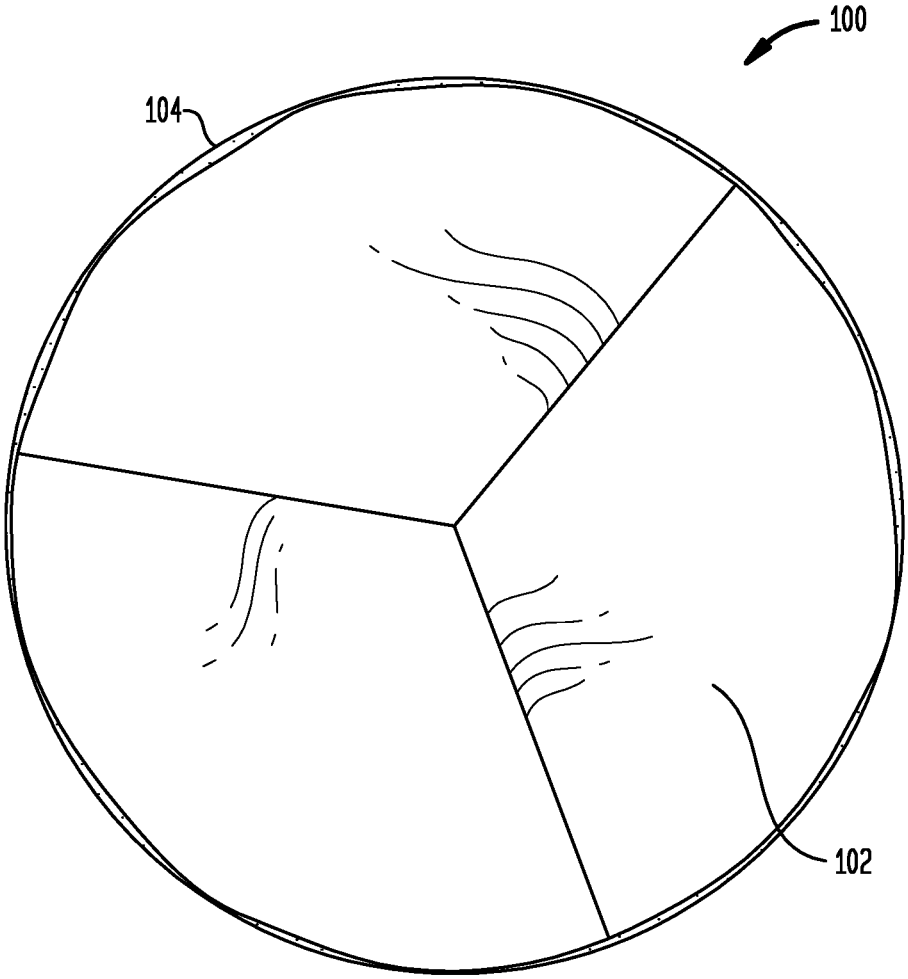
FIG. 2 is a rear view of the disposal device of FIG. 1 showing a folded bag-like member attached to the rear of the absorbent member.

In the depicted embodiment of the present invention, bag-like member 104 is collapsed and folded onto the rear side of disposal device 100 as shown in the rear view of FIG. 2 for compact storage and transport. That is, bag-like member 104 is folded in a manner in which it extends a minimal distance from the back 114 of absorbent member 104. In the depicted embodiment, bag-like member 104 is folded into three pie-like pieces to facilitate storage, packaging, and transport. However, alternate methods of folding bag-like member may be substituted, or bag-like member 104 may remain unfolded, without departing from the scope hereof.

It should be noted that the present invention may be easily used as a training pad for pets. In this use, the absorbent member and its folded bag-like member are simply placed upon a floor or similar surface with the outwardly facing surface 113 of pad 112 facing up (or in the direction in which the pet will use the pad). After the pet urinates and/or defecates on the pad 112, the waste may be disposed of by picking up the disposal device and following the method described below with regards to FIG. 5. As described above, the size of the pad and/or disposal device may be varied as needed to accommodate varying sizes of pets.

Figure 5:
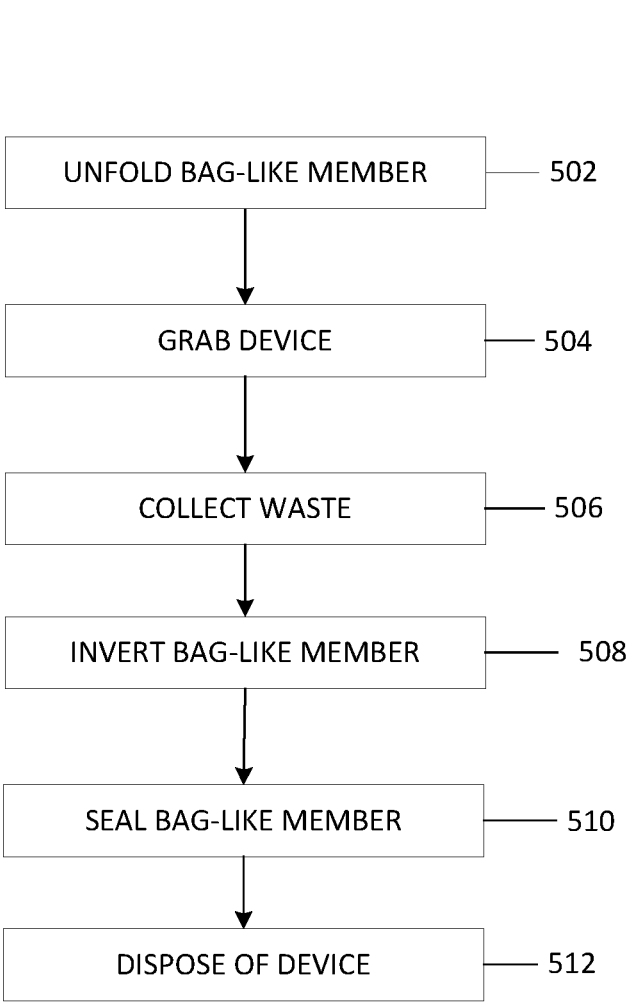
FIG. 5 is a method of using a disposal device in accordance with one embodiment of the present invention.

Next, turning to FIG. 5, depicted is one method of disposing of waste in accordance with the present invention. First, at 502, a person desiring to collect waste would first unfold bag-like member 102. In a scenario in which disposal device is being utilized as a training pad, the disposal device may be first lifted from the ground or other surface to allow the bag-like member to be unfolded.

Next, at 504, a user places his or her hand 106 through open end 108 and into the interior of bag-like member 102 and grabs either the absorbent member or the bag-like member in an area in which control may be exerted over the absorbent member. In an embodiment incorporating a grip internal to the bag-like member, step 504 may also include grabbing or otherwise coupling the hand to the grip (e.g., sliding a finger or hand through the grip).

Next, at 506, the user then collects the waste to be disposed. This step may include, for example, positioning the outwardly facing surface 113 of pad 112 onto the liquid portion of such waste, if any, for collection thereof by allowing the liquid to be absorbed into pad 112. Alternatively, or in addition to absorbing liquid waste, the user may optionally grab any non-liquid waste by wrapping pad 112 around such non-liquid waste. It should be noted that in an embodiment in which the disposal device is used as a training pad, this step may be omitted as, prior to step 502, the disposal device is placed on the ground or other surface prior to creation of the waste and the waste is thereafter deposited onto the pad. However, in some training pad uses, it may be necessary to also collect waste if the animal was not able to completely locate all of the waste on the surface of the pad (i.e., the dry areas of the pad may be used to clean the area adjacent to the original training pad location).

Thereafter, at 508, the user inverts bag-like member 102 such that it surrounds absorbent member 104. This may be done, for example, by grabbing the open end 108 of bag-like member 102 with the user's hand that is not holding absorbent member 104 and inverting bag-like member 102 such that absorbent member 104 and any associated waste is now inside of bag-like member 102. Or, absorbent member 104 and any associated waste may be pulled into bag-like member 102, thereby causing inversion of the latter. Regardless of how the bag-like member is inverted, absorbent member 104 and the collected waste is then contained within bag-like member 102. Collected waste may include waste grabbed by the user during step 506 or it may include waste left on the pad by an animal prior to step 502 without departing from the scope hereof.

Then, at 510, the inverted bag-like member 102 can optionally be sealed with a clasp, drawstring, flexible tie, tape, knot or the like to prevent leakage. For example, in the embodiment of the present invention depicted in FIGS. 1-4, handles 118 may be tied together to seal the contents of bag-like member 102 therein. Finally, at 512, the device may be disposed of in an environmentally and sanitarily appropriate method.

Although the disposal device is designed for the cleanup of liquid spills and associated matter, the disposal device may also be used for cleanup of non-liquid matter that is not associated with a liquid spill without departing from the scope hereof.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A waste collection, removal, and/or disposal device comprising:
- an absorbent member; and
- a bag-like member having an open end and an opposite closed end, said closed end coupled to a back surface of said absorbent member;
- wherein the closed end of the bag-like member has a boundary substantially similar to a perimeter of the absorbent member;
- wherein the bad-like member extends from the closed end with a substantially consistent cross section.

2. The device of claim 1, wherein the absorbent member includes a pad.

3. The device of claim 1, wherein the absorbent member includes a pad and a back, wherein the closed end of the bag-like member is coupled to the back.

4. The device of claim 1, wherein the bag-like member is folded such that it extends a minimal distance from a rear of the absorbent member, and such that the bag-like member is not visible when viewing a face of the absorbent member.

5. The device of claim 1, wherein the bag-like member includes at least one handle or grip interior to the bag-like member and adjacent or fixed to the back surface of the absorbent member.

6. The device of claim 1, wherein the absorbent member is saturated with at least one of a disinfectant, an antibacterial, a cleaning agent, and combinations thereof.

7. The device of claim 1, wherein the absorbent member is coupled to the bag-like member via an adhesive.

8. The device of claim 1, wherein the interior of the bag-like member forms a single reservoir when opened.

9. The device of claim 1, wherein the boundary of the closed end of the bag-like member is substantially similar to the perimeter of the absorbent member when the device is in a storage configuration.

10. The device of claim 9, wherein the bag-like member is folded completely behind the back of said absorbent member in the storage configuration.

11. A method for collecting, removing, and/or disposing of waste comprising:
- inserting a hand through an open end of a disposal device, said disposal device including:
  - an absorbent member; and
  - a bag-like member having an open end and an opposite closed end, said closed end coupled to a back surface of said absorbent member;
  - wherein the closed end of the bag-like member has a boundary substantially similar to a perimeter of the absorbent member;
  - wherein the bag-like member extends from the closed end with a substantially consistent cross section, and;
- grabbing the closed end of said bag-like member from an interior surface;
- collecting waste; and
- continuing to grasp the interior of the bag-like member while inverting said bag-like member so that the absorbent member is inside the bag-like member.

12. The method of claim 11, wherein said collecting waste includes at least one of the group comprising absorbing liquid associated with said waste into said absorbent member, enclosing non-liquids associated with said waste with said absorbent member, and combinations thereof.

13. The method of claim 11, wherein inverting said bag-like member includes pulling said closed end through said open end.

14. The method of claim 11, wherein the interior of the bag-like member forms a single reservoir when opened.

15. The method of claim 11 further comprising sealing the bag-like member.

16. The method of claim 11, wherein the boundary of the closed end of the bag-like member is substantially similar to the perimeter of the absorbent member when the device is in a storage configuration.

* * * * *